United States Patent [19]

Cohen et al.

[11] 4,355,515

[45] Oct. 26, 1982

[54] MOISTURE REMOVAL STRUCTURE FOR CROSSOVER CONDUITS

[75] Inventors: Albert Cohen, Nether Providence; Ralph D. Brown, Springfield; William D. Scott, Upper Chichester, all of Pa.

[73] Assignee: Westinghouse Electric Corp., Pittsburgh, Pa.

[21] Appl. No.: 183,688

[22] Filed: Sep. 3, 1980

[51] Int. Cl.[3] ..... F01K 21/06

[52] U.S. Cl. ..... 60/657; 60/670; 60/646

[58] Field of Search ..... 60/646, 657, 670

[56] References Cited

U.S. PATENT DOCUMENTS 2,798,359 7/1957 Foster et al. ..... 60/657 X 4,282,715 8/1981 Edwall et al. ..... 60/646

*Primary Examiner*—Allen M. Ostrager

*Attorney, Agent, or Firm*—G. H. Telfer

[57] ABSTRACT

A crossover conduit structure for transmitting steam from a first to a second turbine section having a conduit disposed between an exhaust portion of the first turbine section and an inlet portion of the second turbine section and a moisture removal structure situated downstream from the inlet portion axially along the conduit. The conduit's longitudinal axis is arranged generally perpendicular to the inlet portion's longitudinal axis with the moisture removal structure being disposed axially downstream from the inlet portion in the direction of the steam flow through the crossover conduit. The moisture removal structure includes a tapered transition section having first and second ends which are respectively disposed relatively adjacent and remote from the inlet portion, a pipe attached to the second end of the tapered portion, and an orifice or other means for regulating water and steam flow through the condensate pipe. The first end of the tapered transition section has an inside diameter at least as large as the crossover conduit while the second end has an inside diameter less than the first end. The orifice or other flow regulating means controls water and steam flow through the water transmitting means or pipe so as to effectively limit the steam flow quantity passing through the pipe in bypassing relationship with the second turbine section.

2 Claims, 3 Drawing Figures

MOISTURE REMOVAL STRUCTURE FOR CROSSOVER CONDUITS

BACKGROUND OF THE INVENTION

1. Field of the Invention

This invention relates to intraturbine section crossover steam conduit and, more particularly, to means for removing moisture from the steam in the crossover conduits.

2. Description of the Prior Art

Large steam turbine apparatus such as are commonly used in large central station power generation facilities include multiple cylinders or turbine sections in which steam is successively expanded through to rotate a turbine rotor which is coupled to a generator rotor. Steam transmission between cylinders or sections is usually provided by crossover conduit structures which include conduits which are arranged between the individual cylinders. The most common placement of crossover conduit structures is between high and low pressure cylinders. Steam passing through such crossover conduit structures usually has a thermodynamic state which fall in the so-called "wet region" where some moisture has condensed.

Such condensate has a propensity for collecting on the inside of the conduit and on the high pressure cylinder's exhaust opening when the turbine is operating at loads less than the design load. The most common cause for such increase in steam moisture content at reduced load is the relatively lower steam temperature entering the turbine. Droplets of the collected moisture are intermittently stripped from the conduit's interior by the high velocity steam passing therethrough. The separated droplets are accelerated by the high velocity steam, strike many of the low pressure turbine cylinder components, and cause erosion of certain parts such as the turbine rotor and blades. Such erosion can adversely effect the performance and reliability of the low pressure turbine section.

SUMMARY OF THE INVENTION

In accordance with the present invention, a multi-section steam turbine apparatus is provided in which moisture is removed from the motive steam at a location between the turbine sections. The invention generally comprises first and second turbine sections and a steam cross-over structure including a conduit for transmitting steam between the turbine sections and a moisture removal structure for extracting the moisture from the steam passing through the conduit. The conduit connects an exhaust portion of one turbine section with an inlet portion of another turbine section and has a longitudinal axis generally perpendicular to and intersecting with the inlet portion's longitudinal axis. The moisture removal structure is connected to the conduit and generally extends beyond the inlet portion in the direction of steam flow through the conduit. The moisture removal structure has a tapered transition section whose cross section adjacent the inlet portion is at least as large as the conduit's inside diameter and whose end which is remote from the inlet portion has an inside diameter less than the other end. The moisture removal structure further constitutes means for transmitting the removed moisture away from the transition section and means for preventing steam flow through the water transmitting means.

In a preferred embodiment of the present invention, the steam flow preventing means comprises an orifice disposed in the water transmitting means for regulating the flow of water therethrough and providing a predetermined level of water in the water transmitting means upstream from the orifice.

BRIEF DESCRIPTION OF THE DRAWINGS

The invention will be more fully understood from the following detailed description of a preferred embodiment, taken in connection with the accompanying drawings, in which.

DESCRIPTION OF THE PREFERRED EMBODIMENT

The present invention is concerned primarily with moisture removal from steam expanding through a steam turbine. Accordingly, in the description which follows, the invention is shown embodied in a large, multi-section steam turbine.

Figure 1:
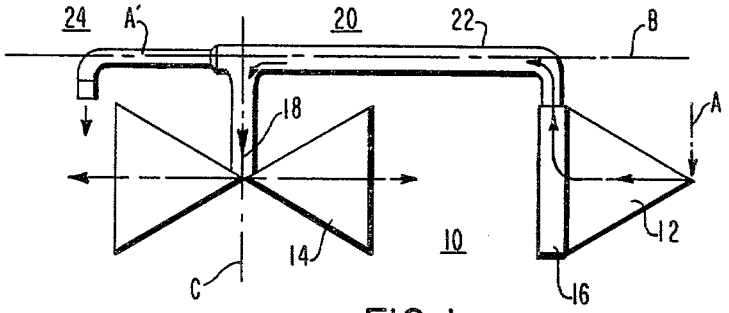
FIG. 1 is a schematic view of a multi-sectioned steam turbine in which the invention is incorporated.

Steam turbine apparatus 10 is illustrated in operating position in FIG. 1 and includes a first, high pressure turbine cylinder or section 12 and a second, low pressure turbine section 14. A typical steam flow path through the turbine apparatus 10 is illustrated by the dashed arrows A which shows the motive steam entering high pressure section 12, expanding through high pressure section 12 to exhaust portion 16, entering inlet portion 18 of the second turbine section 14, and expanding through the low pressure section 14. Cross-over structure 20 fluidly connects exhaust portion 16 and inlet portion 18 so as to permit transmission of steam therebetween. Cross over structure 20 includes conduit 22 through which the steam is actually transmitted and moisture removal structure 24 which is disposed axially beyond the inlet portion in the normal direction of steam flow through the conduit 22. Conduit 22 has a longitudinal axis B which is arranged generally perpendicular to longitudinal axis C of inlet portion 18. Steam vapor passing through conduit 22 has a relatively low momentum so as to facilitate its entry into inlet portion 18 of low pressure turbine section 14. Water droplets which condense from the steam vapor tend to collect on the inside of exhaust portion 16 and conduit 22 especially during periods of lower load which is often accompanied by lower steam temperatures entering high pressure turbine section 12. Intermittently, droplets of that condensate are stripped and entrained in high velocity steam vapor from exhaust portion 16 and conduit 22. To prevent water droplet entry into inlet portion 18, moisture removal structure 24 is added downstream from conduit 22. The water droplets previously entrained in the steam have a higher momentum than the steam vapor and thus follow a path indicated by A' from the point where the steam vapor turns into inlet portion 18.

Figure 2:
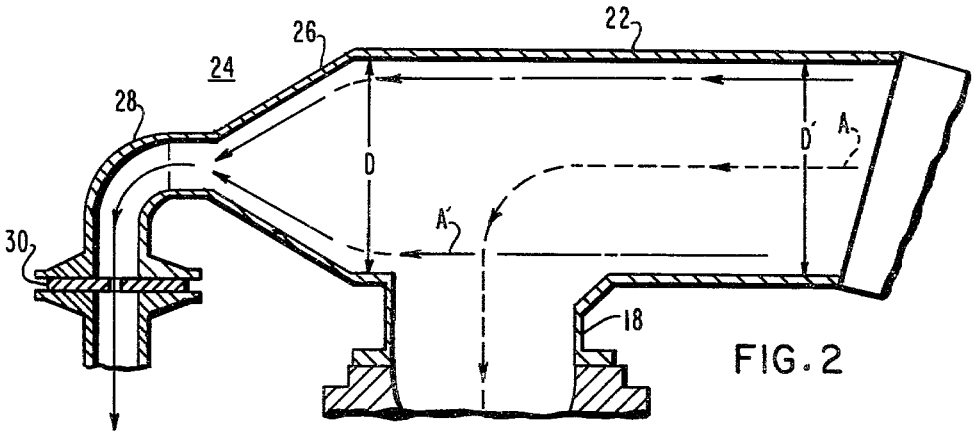
FIG. 2 is an enlarged transverse sectional view of the moisture removal structure illustrated in FIG. 1.

FIG. 2 is an enlarged sectional view of the preferred embodiment of the moisture removal structure 24 and its relative configuration with steam conduit 22. As seen from FIG. 2, moisture removal structure 24 includes a tapered transition section 26, pipe 28 or means for transmitting water away from the transition section and means for preventing steam vapor flow through the water transmitting means or orifice 30. The first end of the tapered transition section is considered to be adjacent inlet portion 18 and connected to it as well as to steam conduit 22 while the second end of tapered transition section 26 is remote from the inlet portion 18 and is connected to drain pipe 28. The first end of tapered transition section 26 has an inside dimension D which is at least as large as the inside diameter D′ of steam conduit 22 so as to ensure collection by transition section 26 of any moisture droplets which are torn loose from conduit 22 and travel along the wall thereof. Orifice plate 30 has orifice 30′ which regulates the flow of high moisture steam therethrough. Such flow regulation of wet steam prevents excess steam vapor from passing through drain pipe 28 and bypassing turbine section 14. For central station power generation applications, the moist steam typically vents to a feedwater heater or other low pressure sink.

Figure 3:
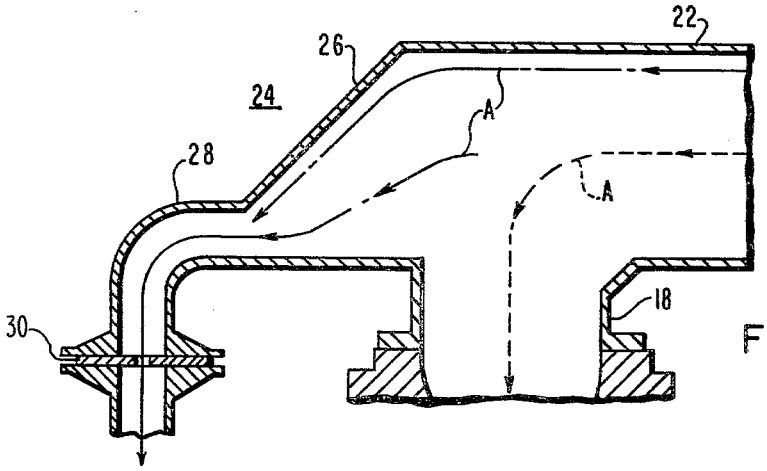
FIG. 3 is an enlarged transverse sectional view of an alternate embodiment to that illustrated in FIG. 2.

FIG. 3 is an alternate embodiment of the design shown in FIG. 2. The tapered transition section 26′ of FIG. 3 has a cross sectional area which undergoes an identical cross sectional area reduction as does the tapered transition section 26 of FIG. 3, but tapered transition section 26′ is tapered only from the wall of steam conduit 22 furthest radially removed from inlet portion 18 while tapered transition section 26 constitutes the frustum of a cone having its longitudinal axis parallel to steam conduit 22's longitudinal axis B. The tapered transition sections 26 and 26′ provide a collection arrangement whereby moisture passing through steam conduit 22 is diverted away from inlet portion 18 and is concentrated in drain pipe 28 so as to reduce the size and cost of the water transmitting means from the second end of tapered transition section.

It will now be apparent that an improved steam turbine apparatus has been provided in which moisture removal from the motive steam vapor is utilized to reduce erosion of the low pressure turbine section's cylinder, rotor, and blading as well as improving the reliability of the entire turbine apparatus and increasing the thermodynamic efficiency of the turbine apparatus due to the reduction in losses sustained from passing moisture through the turbine apparatus.

We claim:

1. A steam turbine apparatus comprising:

first and second turbine sections respectively including exhaust and inlet portions; and a steam crossover structure for transmitting steam from said exhaust portion to said inlet portion, said crossover structure including a conduit having a longitudinal axis perpendicular to the longitudinal axis of said inlet portion and a moisture removal structure disposed beyond said inlet portion in the direction of steam flow through said conduit, said moisture removal structure constituting a tapered transition section having first and second ends, said first end being adjacent said inlet portion and having an inside diameter at least as large as said conduit's inside diameter, said second end being disposed relatively remotely from said inlet portion and having an inside diameter less than said first end, means for transmitting water away from said transition section's second end, and means for regulating steam and water flow through said water transmitting means.

2. The steam turbine apparatus of claim 1, said steam and water flow regulating means comprising:

a control orifice disposed in said water transmitting means for controlling the flow of water and steam therethrough.

* * * * *